United States Patent [19]

Wadsworth

[11] Patent Number: 4,673,237

[45] Date of Patent: Jun. 16, 1987

[54] CONNECTOR FILTER ADAPTER

[75] Inventor: David L. Wadsworth, Wheaton, Ill.

[73] Assignee: GTE Communication Systems Corporation, Phoenix, Ariz.

[21] Appl. No.: 791,818

[22] Filed: Oct. 28, 1985

[51] Int. Cl.[4] ..... H01R 4/66

[52] U.S. Cl. ..... 439/607; 333/182; 439/620

[58] Field of Search ..... 339/14 R, 143 R, 147 R; 333/182

[56] References Cited

U.S. PATENT DOCUMENTS

| | | | |
|---|---|---|---|
| 3,504,328 | 3/1970 | Olsson | 339/17 C |
| 4,431,251 | 2/1984 | Krantz | 339/147 R X |
| 4,600,256 | 7/1986 | Anttila | 339/147 R X |

FOREIGN PATENT DOCUMENTS

| | | | |
|---|---|---|---|
| 2137436 | 10/1984 | United Kingdom | 339/147 R |

*Primary Examiner*—Eugene F. Desmond

*Attorney, Agent, or Firm*—Gregory G. Hendricks

[57] ABSTRACT

A filter adapter for a connector plug mounted to an inner surface on electromagnetic interference shielding enclosure wall and including a plurality of connector pins. The adapter may be inserted between the connector plug and the enclosure wall to engage each of the connector pins passing therethrough and establish an electrical connection between the pin and the enclosure wall through an electromagnetic interference reducing capacitor, this without the necessity of introducing additional electrical contact points in the conductors as they pass through the enclosure wall.

9 Claims, 1 Drawing Figure

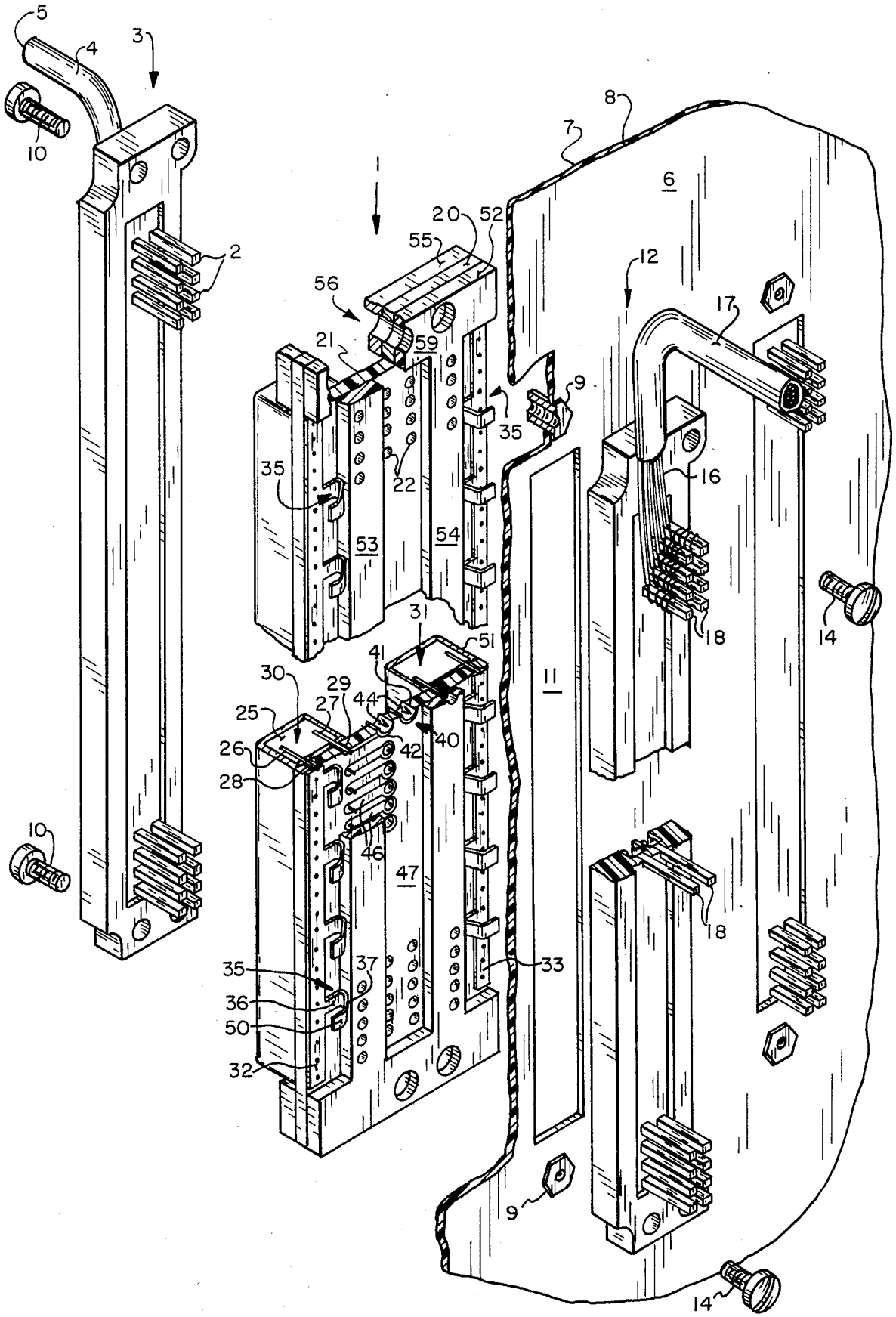
5
4
3
10
2
1
20
52
55
56
21
59
35
22
53
54
31
51
41
30
29
27
44
25
26
28
42
40
46
47
37
36
50
32
33
9
8
7
6
12
17
16
18
14
11

CONNECTOR FILTER ADAPTER

BACKGROUND OF THE INVENTION (1) Field of the Invention

The present invention relates to electromagnetic interference (EMI) filtering and more particularly to an EMI filter adapter for use with a connector plug mounted to an enclosure wall and having a plurality of connector pins protruding therethrough.

(2) Background Art

Many electronic systems are known which emit electromagnetic radiation in their operation. Such radiation is also known, depending on its nature, to affect other electronic systems. In order to control electromagnetic interference between electronic systems government agencies have specified maximum levels of a electromagnetic radiation emissions which may be allowed. These levels must not be exceeded for the equipment to be sold. An optimum method for restricting electromagnetic interference is to totally enclose the interference generating electronic system in a shielded housing thereby restricting all emissions therefrom.

In the area of certain types of systems with widely separated elements such as telephone switching systems, total system enclosure is not possible because subscriber related wiring must leave the system enclosure. In such conditions, allowable levels of emissions have been found obtainable by treating the individual wiring conductors to remove electromagnetic interference traveling on them before the conductors leave the enclosure.

A common way to treat such conductors is to capacitively couple the individual conductors to the enclosure at the point that pass through the enclosure. In this regard, U.S. Pat. No. 4,265,506 to Hollyday is known which teaches a filtered connector assembly for retrofit insertion between a mated connected pair or for use in the original equipment design. The assembly comprises a ground plate having a plurality of filter pin members mounted therethrough, hermaphroditic mounting plates assembled to alternate faces of the ground plate and dielectric insert members received within profile portions of each mounting plate for electrically insulating the filter pin members disposed therein.

U S. Pat. No. 4,215,326 also issued to Hollyday teaches a similar device.

U.S. Pat. No. 4,187,481 to Boutros teaches a filter connector which may be installed between mating connectors of a cable and employs the use multiple feed through capacitors to accomplish EMI filtering. Finally, U.S. Pat. No. 4,264,116 to Gliha Jr. teaches a filter connector with an adapter containing a plurality of feed through capacitors to accomplish EMI filtering.

The above art while operating satisfactorily is seen to teach the addition of EMI filtering by means of the insertion of a filter member in series with the conductors and the employing of expensive feed-through type capacitors.

SUMMARY OF THE INVENTION

The present invention provides an adapter for a connector plug mounted to an electromagnetic interference shielding enclosure wall with pins thereof protruding through an opening in the wall. The adapter is assembled to the connector pins before mounting of the connector plug to the enclosure wall. The filter adapter includes a planar board of electrically nonconductive construction with a plurality of connector pin receiving apertures formed in the board, each of the apertures is engaged with a different one of the connector pins. A plurality of electromagnetic interference reducing means such as capacitors are mounted to a first surface of the board facing the connector plug, a first terminal of the electromagnetic interference reducing means connected to the enclosure wall and including a second terminal. A plurality of conductors are formed on a second surface of the board facing the enclosure wall each conductor extending between a corresponding one of the second terminals and a corresponding connector pin engaged aperture. A spring clip of tubular construction is positioned on each of the apertures to establish connection between the conductor and the connector plug pin.

BRIEF DESCRIPTION OF THE DRAWING

An understanding of the present invention will be apparent from the following description taken in conjunction with the accompanying drawing in which the single FIGURE is an exploded perspective view of the present invention.

DESCRIPTION OF THE PREFERRED EMBODIMENT

Referring now to the single FIGURE of drawings, there is shown a filter adapter 1 in accordance with the present invention. The filter adapter 1 is adapted to be engaged with a plurality of pins 2 of an electromagnetic interference generating connector plug 3, which is connected to electromagnetic interference generating equipment (not shown) by a cable 4 including a plurality of conductors 5. An electromagnetic interference shielding enclosure including an outer surface 6 and an inner surface 7 defining a wall 8 is provided to enclosure and shield the equipment and to which the equipment connector 3 is attached by commonly known means such as a threaded ferrule 9 and screw fastener 10. A plurality of slots or openings 11 are provided in the wall 8, through which the pins 2 extend when the connector plug 3 is attached to the inner surface 7 of the wall 8.

A filtered conductor connector plug 12 is provided outside of the equipment enclosure wall 8 and is adapted to engage the connector pins 2 as they pass out of the wall 8. The filtered conductor connector 12 may be attached to the exterior surface 6 of the wall 8 by commonly known means such as a screw fastener 14 engaged with the ferrule 9. The filtered conductor connector 12 may include a plurality of pin receptacles 18 each attached to a corresponding conductor 16 of a filtered conductor cable 17. The cable 17 may be connected to other equipment (not shown) which will operate with the interference generating equipment within the enclosure.

The filter adapter 1 includes an electrically nonconductive board 20 of elongated construction and including a first side 21. A plurality of apertures 22 are formed in two parallel rows extending along the elongated dimension of the board 20, each of the apertures 22 positioned to engage a respective one of the pins 2 of the connector plug 3. Associated with each of the apertures 22 is an electromagnetic interference reducing capacitor 25 of the noncoaxial, nonfeed-through type having a first grounding terminal 26 and a second terminal 27, both the capacitor terminals positioned within apertures 28 and 29 respectively in the board 20. The capacitors 25 are positioned in a first and a second parallel row 30 and 31, respectively, each adjacent to and outside of a respective one of the rows of the pin receiving apertures 22 on the first side 21 of the board 20. The first terminals 26 of the capacitors 25 within the first row 30 are connected to a first grounding strip 32 by commonly known means such as soldering. Similarly, the first terminals 26 of the capacitors 25 in the second row of capacitors 31 are connected to a second grounding strip 33 also by means such as soldering. The grounding strips 32 and 33 are positioned outside of their corresponding row of capacitors and each includes a plurality of fingers 35 of elongated v-shaped construction including a first arm 36 extending from the grounding strip 32 or 33 perpendicularly away from in an inward direction and parallel to the board 20 a predetermined distance and a second arm 37. Each of the second arms 37 extends from an inward end of the corresponding first arm 36 in an outward direction and away from the first arm 36 at an acute angle with both the first arm 36 and the second arm 37 of a corresponding one of the fingers 35 lying in a plane perpendicular to the rows of apertures and to the elongated dimension of the board 20. Each of the apertures 22 includes therein an eyelet 40 having a cylindrical body portion 41 and a collar portion 42 formed at a first end of the eyelet 40. The eyelet 40 additionally contains a plurality of fingers 44 formed in the cylindrical body portion 41 of the eyelet 40 extending inward of the body portion and in a direction towards the collar 42. The fingers 44 are of resilient construction and are adapted to engage the pins 2 of the connector plug 3 to form a pressure contact connection when the connector plug 3 is assembled to the filter adapter 1. A plurality of conductors 46 are formed on a second surface 47 of the board 20, each extending between a respective one of the second terminals 27 of the capacitor 25 and a respective one of the collars 42 of the eyelets 40 to establish electrical connection therebetween.

Each of the second arms 37 of the grounding fingers 35 includes at a second end thereof, a foot 50 formed extending in an outward direction and parallel to the board 20.

The filter adapter additionally includes a spacer 52 of elongated construction and includes two columns 53 and 54 attached to the second side 47 of the board 20 and extending longitudinally between the grounding fingers 35 of each of the grounding strips 32 and 33 and their associated row of the apertures 20. The spacer 52 is included to provide a predetermined minimum spacing between the board 20 and the enclosure wall 8 to thus prevent crushing of the fingers 35 when the filter adapter is assembled between the wall 8 and the connector plug 3.

A stiffener plate 55 is provided attached to opposite ends of the board 20 on the first side 7 thereof as an aid in retaining the filter adapter 1 in position against the inner surface 7 of the wall 8. Also provided is a hole 56 through the stiffener 55, the board 20 and the spacer 52. The hole 52 may be sized to slidingly engage the ferrule 9 to thus position the pins 2 of the connector 3 within the slot 11. The stiffener plate 55 may be electrically conductive and connected to the hole 52 which may be plated through.

In operation, the filter adapter 1 of the present invention may be applied to a connector plug 3 to treat signals passing out of the enclosure by removing the connector plug 3 from the interior surface 7 of the enclosure wall 8, aligning the pins 2 of the connector plug 3 with the apertures 22 of the filter adapter 1 and applying force on the connector plug 3 in a direction toward the filter adapter 1. Such application of force will cause the pins 2 of the connector plug 3 to engage the eyelets 40 positioned within the apertures 22 of the board 20 and to deflect the fingers 44 of the eyelets thereby permitting passage of the pins 2 through the cylindrical body portions 41 of the eyelets 40 and simultaneously establishing electrical contact therebetween.

Following engagement of the pins 2 with the eyelets 40, the assembly consisting of the connector plug 3 and the filter adapter 1 may be assembled to the interior surface 7 of the wall 8 by means of the screw fasteners 10 and the threaded ferrules 9. As force is applied to the subassembly including the connector plug 3 and filter adapter 1 by the screw fasteners 10, the fingers 35 will engage the inner surface 7 of the wall 8 and be deflected outwardly and towards the board 20 to electrically engage and form contact with the wall 8 thereby establishing an electrical connection between the first terminals 26 of the capacitors 25 and the enclosure wall 8.

Following assembly of the connector plug and filter adapter to the interior surface to the enclosure wall 8, the filtered conductor connector 12 may be assembled to the pins 2 of the connector plug 3 on the exterior surface 6 of the enclosure wall 8 by aligning the connector receptacles 18 with the pins 2 and applying force to the filtered conductor connector 12 in a direction towards the wall 8. Such force will engage the receptacles 18 with the pins 2 and establish electrical connection between the conductors 5 of the interior cable 4 and the conductors 16 of the exterior cable 17.

As an additional aid in effectively filtering conductors passing outside of the enclosure wall 8 there is provided over each row of capacitors 25 an electrically conductive cup-shaped shield 58. The capacitor shields 58 are electrically connected to the enclosure wall 8 by means of the stiffener plate 55 and the plated-through hole 56 passing through the board 20 and the spacer 55 and terminating in a plated surface 59 of the spacer 52 facing the wall 8.

Although the preferred embodiment of the present invention has been illustrated, and the form described in detail, it will be readily apparent to those skilled in the art that various modifications may be made therein without departing from the spirit of the invention or from the scope of the appended claims.

What is claimed is:

1. A filter adapter for a connector plug including a plurality of connector pins and mounted to an inner surface of an electromagnetic interference shielding enclosure wall with said connector pins protruding through an opening in said wall, said filter adapter comprising:

a board of planar electically nonconductive construction positioned between said connector plug and said enclosure wall, said board including at least a first surface;

said board of elongated construction;

a plurality of connector pin receiving apertures formed in said board, and said apertures formed in two parallel rows extending along the elongated dimension of said board, each of said apertures engaged with a different one of said connector pins;

a plurality of electromagnetic interference reducing means each including a first terminal connected to said enclosure wall and further including a second terminal;

a plurality of conductors each positioned on said board first surface and connected between a different one of said electromagnetic interference reducing means second terminals and each connected to a distinct one of said connector plug pins;

said electromagnetic interference reducing means positioned in two parallel rows on a second surface of said board, each of said electromagnetic reducing means positioned outward of and adjacent to said connected pin; and said filter adapter further including a pair of grounding strips each positioned outward of a corresponding one of said interference reducing means rows on said board first surface and connected to a corresponding one of each of said electromagnetic interference reducing means first terminals within a row, each of said grounding strips including a plurality of fingers in contact with said enclosure wall.

2. A filter adapter as claimed in claim 1, wherein: said filter adapter further includes an electrically conductive eyelet positioned within each of said aperturès, said eyelets each including a central cylindrical body portion in contact with said engaged respective pin and a collar portion formed at a first end of said cylindrical body portion and in contact with said respective conductor, said eyelet establishing electrical connection between said conductor and said pin.

3. A filter adapter as claimed in claim 2, wherein: said eyelet includes a plurality of fingers formed in said cylindrical body portion, each finger extending inward in a direction toward said board first side and engaging said respective pin to form a pressure contact electrical connection with said pin.

4. A filter adapter as claimed in claim 1, wherein: said grounding finger is of elongated v-shaped construction including a first arm attached to said grounding strip at a first end and extending perpendicularly away from and inward of said filter adapter grounding strip and parallel to said board, and a second arm attached at a first end to a second end of said first arm and extending outward and in a direction away from said board at an acute angle with respect to said first arm, said arms of each finger lying within a grounding finger plane perpendicular to said rows of apertures.

5. A filter adapter as claimed in claim 4, wherein: said finger second arm includes a second end including a foot extending therefrom in an outward direction and parallel to said board, said foot lying in said grounding finger plane.

6. A filter adapter as claimed in claim 5, wherein: said filter adapter further includes a spacer of elongated planar construction positioned between said board and said enclosure wall, said spacer of predetermined thickness to prevent crushing of said ground strip fingers when said filter assembly is assembled to said enclosure wall.

7. A filter assembly as claimed in claim 1, wherein: said electromagnetic interference reducing means includes a capacitor.

8. A filter assembly as claimed in claim 7, wherein: said capacitors are enclosed within at least one shield of cup-shaped construction, said shield electrically connected to said enclosure wall.

9. A filter assembly as claimed in claim 7, wherein: said capacitor is of the nonfeed-through variety with leads of the radial variety.

* * * * *